US009016295B2

(12) United States Patent
Wise

(10) Patent No.: US 9,016,295 B2
(45) Date of Patent: Apr. 28, 2015

(54) PATIO UMBRELLA WITH AIR PUMP

(71) Applicant: Robert F. Wise, Okotoks (CA)

(72) Inventor: Robert F. Wise, Okotoks (CA)

( * ) Notice: Subject to any disclaimer, the term of this patent is extended or adjusted under 35 U.S.C. 154(b) by 0 days.

(21) Appl. No.: 14/150,227

(22) Filed: Jan. 8, 2014

(65) Prior Publication Data

US 2014/0182639 A1 Jul. 3, 2014

Related U.S. Application Data

(63) Continuation-in-part of application No. 12/930,074, filed on Dec. 28, 2010, now abandoned.

(51) Int. Cl.

| | |
|---|---|
| ***A45B 25/14*** | (2006.01) |
| ***A45B 19/02*** | (2006.01) |
| ***A45B 25/16*** | (2006.01) |

(52) U.S. Cl.

CPC ..... *A45B 25/14* (2013.01); *A45B 25/165* (2013.01)

(58) Field of Classification Search

USPC ..... 135/16, 98, 20.2, 20.3, 116, 905; 116/174; 248/404, 188.5; 297/344.12, 297/344.18, 344.19; 239/280, 280.5, 289; 108/50.12

See application file for complete search history.

(56) References Cited

U.S. PATENT DOCUMENTS

| | | | | |
|---|---|---|---|---|
| 1,411,560 | A * | 4/1922 | Beaty | 135/20.2 |
| 2,595,837 | A * | 5/1952 | Freeman | 211/10 |
| 2,753,878 | A * | 7/1956 | Halberstam | 135/20.2 |
| 3,213,868 | A | 10/1965 | Forbes | |
| 4,951,911 | A * | 8/1990 | Zatopek et al. | 248/362 |
| 5,213,122 | A | 5/1993 | Grady, II | |
| 5,291,908 | A | 3/1994 | Grady, II | |
| 5,516,070 | A * | 5/1996 | Chapman | 248/404 |
| 6,543,464 | B1 | 4/2003 | Grady, II | |
| 6,913,030 | B1 | 7/2005 | Chmelik Martinec | |
| 7,044,145 | B2 * | 5/2006 | Bouchard | 135/98 |
| 7,631,653 | B2 * | 12/2009 | Young et al. | 135/15.1 |
| 7,806,381 | B2 * | 10/2010 | Sisk Horne et al. | 248/354.5 |
| 7,891,633 | B2 * | 2/2011 | Li | 248/519 |
| 7,909,048 | B2 | 3/2011 | Chmelik Martinec | |
| 8,069,870 | B2 | 12/2011 | Gridley | |
| 2005/0045217 | A1 | 3/2005 | Clarke | |
| 2005/0189454 | A1 * | 9/2005 | Smith et al. | 248/127 |
| 2008/0048051 | A1 * | 2/2008 | Chang | 239/289 |
| 2008/0156252 | A1 * | 7/2008 | Al-Tawarh | 116/174 |
| 2011/0203624 | A1 | 8/2011 | Wise | |

* cited by examiner

*Primary Examiner* — Winnie Yip

(74) *Attorney, Agent, or Firm* — Kyle R. Satterthwaite; Ryan W. Dupuis; Ade & Company Inc.

(57) ABSTRACT

An integrated pole unit is connected to a patio umbrella canopy and allows the canopy to be raised by a foot, hand or low pressure compressor pump and lowered by releasing air via an air pressure valve. The external umbrella pole is hollow with a slit at the top and contains an "internal pole mechanism" with a metal insert that is attached to the base of the canopy and moves up the slit with increased air pressure in the pole, which raises the umbrella canopy. There is an air pressure valve that, when closed, keeps the umbrella canopy in the full open position, and when open, releases the air, resulting in the umbrella canopy closing automatically in a slow and controlled manner.

14 Claims, 3 Drawing Sheets

PATIO UMBRELLA WITH AIR PUMP

CROSS REFERENCE TO RELATED APPLICATIONS

This application is a continuation in part of application Ser. No. 12/930,074, filed Dec. 28, 2010, which claims benefit under 35 U.S.C. 119(a) of Canadian Patent Application Serial No. 2,698,206, filed Feb. 19, 2010.

BACKGROUND OF THE INVENTION

1. Field of the Invention

This invention relates generally to a device that raises and lowers an umbrella canopy.

2. Description of the Related Art

Common mechanisms that are used to raise and lower umbrella canopies include the push, crank and rope methods. The "push" method uses manual power with a person literally pushing up the umbrella canopy up until it locks into place. The "rope" method requires that an individual pull on a rope that is attached to the canopy causing it to open and then locking it into place with a pin. The "crank" method uses a mechanism that is attached mid way up the umbrella pole and when turned either raises or lowers the umbrella canopy depending on the direction it is turned. Although these are all effective methods of raising, and lowering an umbrella canopy, they are cumbersome for the person completing the task as these methods often require standing, leaning over the patio table, significant arm strength and a person of good height to easily secure the umbrella in place. This can be difficult for individuals with ailments, such as arthritis, or people with little upper body strength or the disabled. Repairs on these systems are also inconvenient.

BRIEF SUMMARY OF THE INVENTION

According to one aspect of the invention, there is provided a device for raising an umbrella canopy with air pressure, the device including:

- an external pole having a base at which the external pole is sealed;
- an internal pole mechanism received inside the external pole and sealed thereto above the base in a manner movable up and down within the external pole;
- an air connection system connected to the external pole;
- an air pump connected to the external pole by the air connection system and operable to pump air into the external pole to increase air pressure in the external pole and thereby raise the internal pole mechanism upwardly within the external pole;
- a longitudinal slit in the external pole; and
- an insert sticking out from the internal pole mechanism through the slit in the external pole and attached to a base of the umbrella canopy for lifting of the umbrella canopy under raising of the internal pole mechanism by operation of the air pump.

The device may include an air pressure valve attached to the external pole and operable between a closed position retaining air in the external pole to keep the canopy open, and an open position allowing escape of the air to lower the air pressure and cause falling of the internal pole mechanism and closing of the canopy.

The air pump may be a compressor, a hand pump, or a foot pump.

According to another aspect of the invention, there is provided a method of raising an umbrella canopy with air pressure, the method comprising using an air pump to force air into an external pole in a manner causing an internal pole mechanism to rise upwardly inside the external pole so that the umbrella canopy is raised by an insert that sticks outward from the internal pole mechanism through a slit in the external pole and attaches to a base of the umbrella canopy.

According to yet another aspect of the invention, there is provided a device for raising an umbrella canopy or other shading device with air pressure, the device comprising:

- an external pole having a base at which the external pole is sealed;
- an internal pole received inside the external pole and sealed thereto above the base in a manner movable up and down within the external pole;
- an air connection system connected to the external pole;
- an air pump connected to the external pole by the air connection system and operable to pump air into the external pole to increase air pressure in the external pole and thereby raise the internal pole mechanism upwardly within the external pole;
- a longitudinal slit in the external pole;
- an insert sticking out from the internal pole mechanism through the slit in the external pole to carry a base of the umbrella canopy or other shading device for lifting of the umbrella canopy under raising of the internal pole mechanism by operation of the air pump; and
- a lubrication opening on the internal pole at a position thereon that is accessible with the umbrella canopy or other shading device in a fully raised position.

According to a further aspect of the invention, there is provided a device for raising an umbrella canopy or other shading device with air pressure, the device comprising:

- an external pole having a base at which the external pole is sealed;
- a longitudinal slit in the external pole that communicates an interior of the external pole with an interior thereof;
- an internal pole received inside the external pole and having a sliding seal thereon that forms an air-tight seal between the internal and external poles at an area location between the base of the external pole and a lower end of the longitudinal slit, the internal pole and the sliding seal thereon being slidable up and down within the external pole;
- an air connection to the external pole for introduction of pumped air into the external pole at a location between the base of the external pole and the sliding seal on the internal pole;
- a carrier connected to the internal pole mechanism and extending through the longitudinal slit in the external pole to carry a base of the umbrella canopy that is slidably disposed along an exterior of the external pole for lifting of the umbrella canopy by pressurization of the external pole via the air connection in order to raise the carrier from a lowered position in contact with the lower end of the longitudinal slit to a raised position in contact with an opposing upper end of the longitudinal slit; and
- a longitudinal lubrication channel recessed into an exterior wall of the internal pole at an exterior surface thereof without passing through said exterior wall of the internal pole, the longitudinal lubrication channel extending upwardly from the sliding seal and being positioned to circumferentially align with both the carrier and the longitudinal slit and to axially reach the longitudinal slit in the external pole with the carrier in the raised position to enable lubrication of the sliding seal via the longitudinal slit and the lubrication channel with the carrier in the raised position;

wherein an axial length of the longitudinal slit in the external pole is less than a longitudinal distance measured along the internal pole from the carrier to the sliding seal so that the sliding seal remains below the lower end of the longitudinal slit throughout a full range of movement of the carrier between the raised and lowered positions in the longitudinal slit, thereby maintaining the air-tight seal with the external pole at all times.

Preferably the sliding seal comprises a neoprene/silicone seal.

Preferably lubricant is applied to the sliding seal. In one embodiment, a silicone lubricant is employed.

Preferably there is provided an air hose having an output end for coupling to the air connection of the external pole, an input end for coupling to an air pump and a length of at least 5 feet between the intake and output ends thereof.

Preferably an air control valve is operably connected to the air hose at a distance of at least 5-feet along the hose from the output end of said air hose.

According to yet a further aspect of the invention, there is provided a device for raising an umbrella canopy or other shading device with air pressure, the device comprising:

an external pole having a base at which the external pole is sealed;

a longitudinal slit in the external pole that communicates an interior of the external pole with an interior thereof;

an internal pole received inside the external pole and having a sliding seal thereon that forms an air-tight seal between the internal and external poles at an area location between the base of the external pole and a lower end of the longitudinal slit, the internal pole and the sliding seal thereon being slidable up and down within the external pole;

an air connection to the external pole for introduction of pumped air into the external pole at a location between the base of the external pole and the sliding seal on the internal pole;

a carrier connected to the internal pole mechanism and extending through the longitudinal slit in the external pole to carry a base of the umbrella canopy that is slidably disposed along an exterior of the external pole for lifting of the umbrella canopy by pressurization of the external pole via the air connection in order to raise the carrier from a lowered position in contact with the lower end of the longitudinal slit to a raised position in contact with an opposing upper end of the longitudinal slit; and a longitudinal lubrication channel recessed into an exterior wall of the internal pole at an exterior surface thereof without passing through said exterior wall of the internal pole, the longitudinal lubrication channel extending upwardly from the sliding seal, having a circumferential position on the internal pole that matches circumferential positions of the carrier and the longitudinal slit, and having an axial length sufficient to reach up to the longitudinal slit with the carrier in the raised position so as to place a top end of the lubrication channel at the longitudinal slit when the carrier is in the raised position for lubrication of the sliding seal via longitudinal slit and said lubrication channel;

wherein an axial length of the longitudinal slit in the external pole is less than a longitudinal distance measured along the internal pole from the carrier to the sliding seal so that the sliding seal remains below the lower end of the longitudinal slit throughout a full range of movement of the carrier between the raised and lowered positions in the longitudinal slit, thereby maintaining the air-tight seal with the external pole at all times.

DETAILED DESCRIPTION OF THE INVENTION

Figure 1:
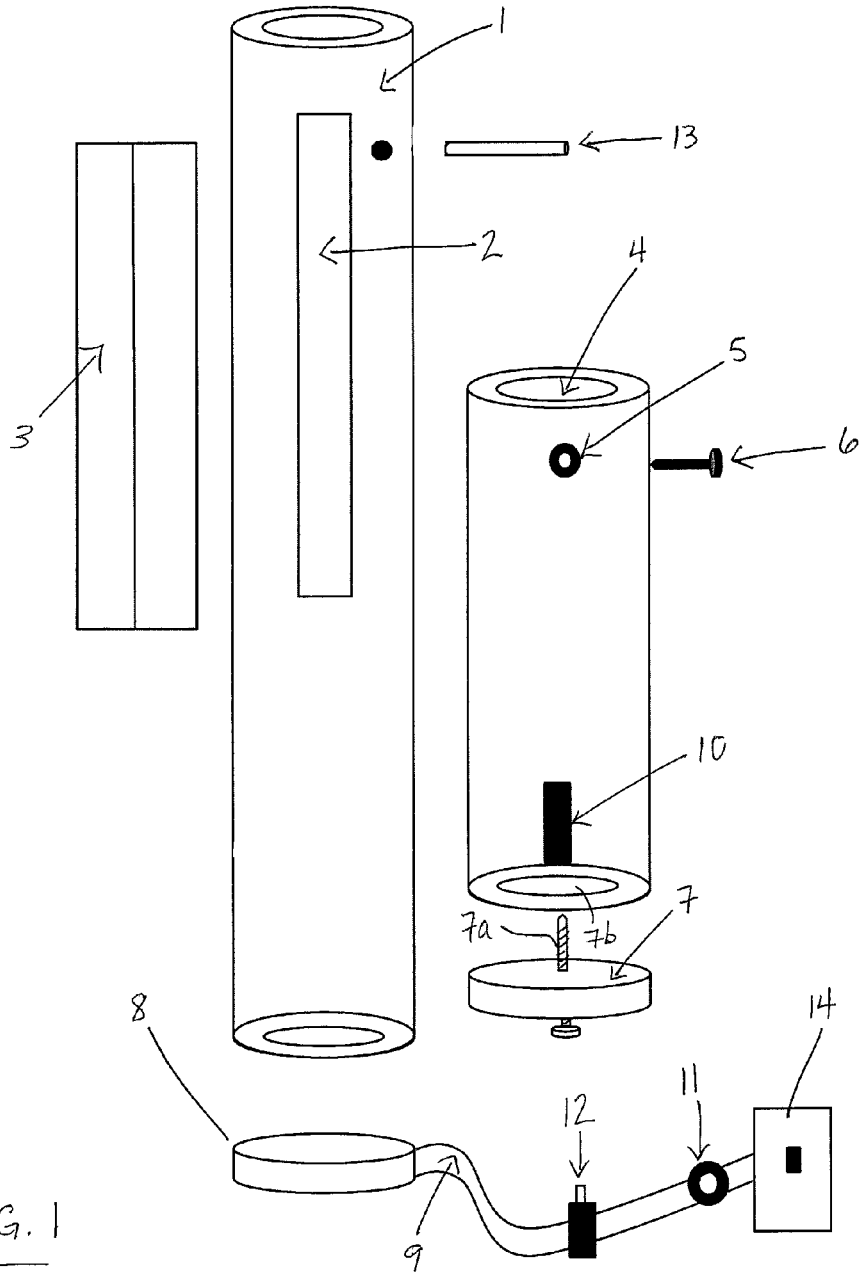
FIG. 1 shows a schematic disassembled view of an umbrella canopy raising and lowering device of the present invention.

Listed in accordance with reference numbers used in the drawing, components of an umbrella canopy raising and lowering device of the illustrated embodiment of the present invention are outlined as follows:

1—hollow umbrella pole

2—"slit in patio umbrella pole". This is a long rectangular opening cut into the hollow umbrella pole ¼% inch in width that extends from the bottom of the canopy when it is in the closed position to the location where the umbrella canopy stops when it is in the fully open position.

3—"slit cover" is optional and is a flexible plastic cover that blocks the opening detailed in element 2.

4—"pole insert" is a solid piece of material, suitable for this function, that fits inside of the hollow umbrella pole and is used to raise the umbrella canopy.

5—"plug for metal insert" is a plug to hold the metal insert (element 6) in place.

6—"metal insert " is a metal device that is inserted into element 4 and extends out of element 2 and attaches to the umbrella canopy and raises the canopy with increased air pressure.

7—"base plug" is a plug made of suitable material that attaches to the bottom of element 4 and seals the unit to retain the air pressure.

8—"base pole cap" is a cap that covers and seals the opening of the base of element 1.

9—"hollow tubing" is attached to element 8 and is used to increase the air pressure in element 1 by connecting a pump (foot, hand, low psi) and is also used to release the air pressure in element 1 via an air valve.

10—"lubrication opening" is an opening at the bottom of element 4 that allows lubrication of the "internal pole mechanism" when the umbrella canopy is in the raised position.

11—"air pressure valve" is installed to seal and release the air pressure of element 1.

12—"pressure relief valve" is installed to automatically release the air pressure if it is too high (optional).

13—"safety device" optional which is a metal rod that will hold the umbrella canopy in the raised position while in use (optional).

14—"pump" which is used to raise the umbrella canopy which may be a hand, foot or low psi compressor pump.

In the following additional description of the components and their cooperation, the term "internal pole mechanism" refers to all the parts that make up the internal pole, which include, but are not limited to, pole insert 4, metal insert plug 5, metal insert 6, base plug 7 and lubrication opening 10.

This patio umbrella pole is an integrated unit that allows for a person to easily, and effortlessly, raise and lower a patio umbrella with the use of an air pump (hand, foot or low psi compressor).

The final product is assembled by modifying the hollow umbrella pole 1 to incorporate the slit 2.

Manufacture of all elements of the "internal pole mechanism" is attained by completing the pole insert 4, metal insert plug 5, and base plug 7 according to the details outlined in the drawing. Insertion of the completed internal pole mechanism into the external hollow umbrella pole is performed until the plug 5 for the metal insert 6 is observable at the bottom of the slit 2. Installation of the metal insert 6 is then performed. After the above steps are complete, attachment of the base pole cap 8 and connection of the hollow tubing 9 are performed to create an air tight seal. The air pressure valve 11 is connected to the tubing 9, which will allow control of the air pressure and lowering of the canopy.

To raise the patio umbrella canopy, connection of the manual foot pump 14, or any kind of low pressure pump, to the hollow tubing is performed. The pump is operated to pump air into the pole 1 to lift the umbrella canopy. It does not take that much pressure to lift the umbrella canopy. The canopy will stay up until the air pressure is released via the valve 11 on the hollow tubing 9, which lowers the air pressure, causing the "internal pole mechanism" to fall and result in the umbrella canopy lowering. The canopy will fall with the metal insert 6 and push the internal pole mechanism down to the lower half of the umbrella pole 1. The canopy lowers slowly and the speed of the fall can be controlled by the air valve 11 on the hollow tubing 9. The umbrella canopy is now in the closed position.

Lubrication opening 10 is used for maintenance to lubricate the interior of the umbrella pole 1 when the canopy is in the fully raised position.

Optional items include the slit cover 3, the pressure relief valve 12 and the safety device 13, which can be used if required.

Figure 2:
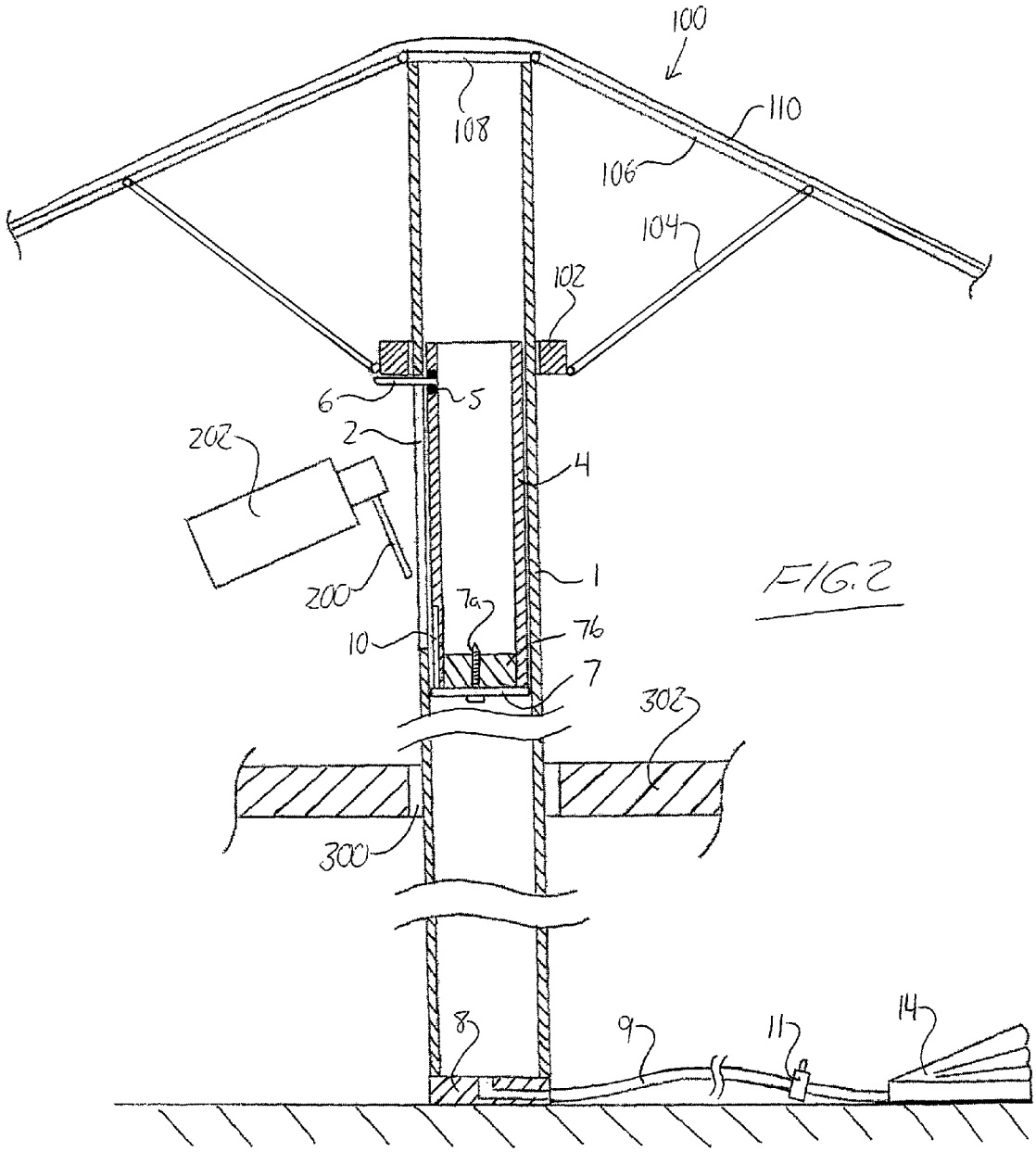
FIG. 2 is a vertical cross section of the umbrella canopy raising and lowering device of FIG. 1 during use, with the device supporting an umbrella canopy in an open position and showing application of lubricant to the device for maintenance of same.
Figure 3:
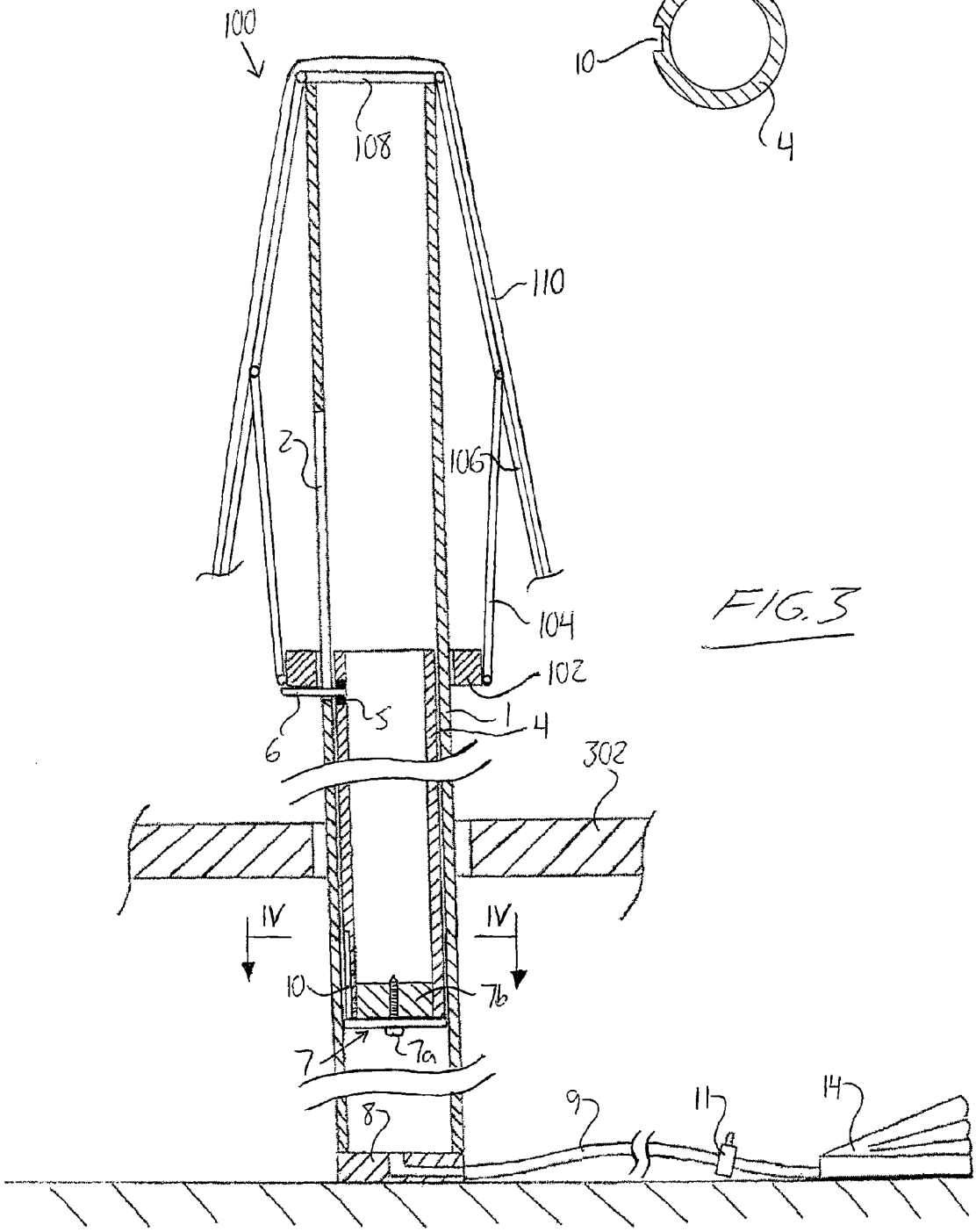
FIG. 3 is a vertical cross section similar to FIG. 2, but with the umbrella canopy in a closed position.

FIGS. 2 and 3 illustrate the device of FIG. 1 in use to control movement of an umbrella canopy 100 between open and closed positions. The canopy 100 is of conventional prior art construction, featuring a canopy base 102 in the form of a ring or collar 102 slidably disposed around the exterior of central post assembly of the umbrella assembly (as defined in the present invention by the external pole 1), a set of struts 104 extending from the canopy base 102, a set of ribs 106 extending from a hub 108 that is mounted atop the central post, and a flexible fabric cover 110 that is fitted over the ribs. Each rib 106 is pivotally coupled to the hub 108, and each strut 104 has its opposing ends pivotally coupled to the canopy base 102 and a respective one of the ribs 106. The canopy base 102 is slidable up and down along the exterior of the central post of the umbrella. In use of the present invention, the canopy base 102 is attached to, or rides atop, the metal insert 6 at the portion of the metal insert 6 that reaches externally of the internal pole insert 4 through the longitudinal slot 2 therein. Accordingly, the metal insert defines a carrier by which canopy base 102 is carried along the external pole 1.

The base plug 7 of the internal insert pole 4 is preferably made of neoprene and/or silicone and is attached to the lower end of the internal insert pole 4 by a screw 7*a* or other means. The internal pole 4 may be a solid rod, or as shown, for reduced weight, a hollow tubular pole may be used that has been equipped with a threaded-in, welded-on or other suitable air-tight closure 7*b* at the bottom end. The resilient plug 7 has a normal diameter slightly exceeding the external diameter of the insert pole 4 and the internal diameter of the hollow outer pole 1, whereby the plug 7 forms an air tight seal between the outer and inner poles 1, 4. The base plug 7 is lubricated, preferably with a silicone lubricant, so as to provide a low-friction sliding interface between the plug and the outer pole 1. The base plug full spans the entire bottom end of the internal pole, providing an air tight seal blocking passage of air through and around the internal pole.

The base cap 8 is attached to the lower end of the outer pole 1 to provide an air-tight seal at this end, and may provide the air connection for feeding pumped air into the interior of the outer pole 1 from the air pump 14 from a location below the base plug 7 that provides the sliding seal between the two poles. Alternatively, a separate air fitting may provide the air connection via a port in the wall of the outer pole 1 near the bottom end thereof. The axial travel of the inner pole 4 along the interior of the outer pole 1 is limited in each direction by contact of the metal insert 6 with the respective top or bottom end of the longitudinal slit 2. When the interior space of the outer tube between the base cap 8 and the base plug 7 is depressurized, the inner pole 4 will gravitationally move down to its fully lowered position, thereby bringing the metal insert 6 into its fully lowered position in contact with the lower end of the longitudinal slit 2 as shown in FIG. 3. Sufficient pressurization of this space by the pump 14 however will raise the internal pole 4 to its fully raised position, thereby bringing the metal insert 6 into its fully raised position in contact with the upper end of the longitudinal slit 2, as shown in FIG. 2.

The axial length of the longitudinal slit 2 in the outer pole 1 is less than the longitudinal distance from the metal insert 6 on the inner pole 4 to the bottom face of the base plug 7 so that the base plug 7 of the inner pole 4 remains below the bottom end of the longitudinal slit 2 at all times (even in the fully raised position of FIG. 2) so as to always maintain the airtight seal between the inner and outer poles.

As shown in FIG. 2, the raising of the internal pole mechanism by air-driven pressurization of the outer pole 1 carries the canopy base 102 on the metal insert 6 up the exterior of the outer pole 1, which due to the pivotal connection of the umbrella struts between the canopy base 102 and the umbrella ribs 106, forces the ribs 106 to pivot outward and upward about their pivotal connections to the hub 108, whereby movement of the internal pole mechanism to its fully raised position brings the umbrella canopy into its fully opened position. On the other hand, when the pressure is released from the space between the base cap 8 and base plug 7 of the outer and inner poles respectively, the weight of the internal pole mechanism and the umbrella cause the canopy base and the internal pole mechanism to gravitationally ride down the outer pole 1. As the base-connected ends of the umbrella struts 104 fall with the descending metal insert 6, the umbrella ribs 106 pivot downward and inward, thereby automatically bringing the umbrella canopy toward the collapsed state of FIG. 3. The internal pole mechanism continues to fall under gravity until the metal insert 6 reaches the bottom of the longitudinal slit 2, thereby marking its fully lowered position. Additionally or alternatively, the fully lowered position of the internal pole mechanism may be marked by contact of the base plug 7 or its screw 7*a* with the base cap 8 at the closed bottom end of the outer pole. That is, the fully lowermost achievable position of the internal pole mechanism may be defined by bottoming out of the metal insert in the slit, or bottoming out of the internal insert pole mechanism with the bottom of the outer pole.

Figure 4:
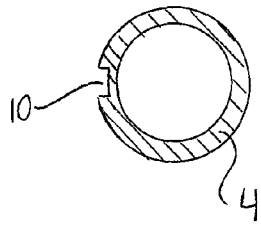
FIG. 4 is a horizontal cross section of an internal pole of the device of FIG. 3, as taken along line IV-IV thereof.

As shown in FIGS. 2 to 4, the lubrication opening 10 is defined by a channel or groove recessed into the exterior surface of the internal pole 4 to run longitudinally upward from the base plug 7 at the lower end of the internal pole toward the opposing upper end of the internal pole 4. This axial channel resides at circumferential position around the internal pole 4 that matches that of the metal insert 6, whereby the channel's circumferential position also matches that of the longitudinal slit 4 in the outer pole 4.

As shown in FIG. 2, the axial length of the lubrication channel 10 is long enough so that when the internal pole mechanism is in its fully lowered state, the lubrication channel 10 reaches an elevation above that of the bottom end of the longitudinal slit 2 in the outer pole 1. The lubrication channel provides a portion of the inner pole's circumference at which the clearance between the exterior of the inner pole 4 and the interior wall of the outer pole 1 is greater than around the remainder of this circumferential space between the poles. With the lubrication channel 10 running upwardly past the lower end of the longitudinal slit 2 when the inner pole 4 is fully raised, this area of extra clearance running down to the base plug 7 of the inner pole 4 from a distance above the bottom end of the longitudinal slit 2 in the outer pole 1 allows the discharge straw 200 of a canister of spray lubricant 202 to be inserted downwardly into this area through the slit 2 in order to allow sprayed application of lubricant in the channel 10, through which the lubricant travels downwardly to the base plug 7 to lubricate same. The lubricant channel 10 thus enables lubrication access to the otherwise inaccessible base plug 7 without removable of same from its installed position in which is maintains an air-tight sliding seal between the poles. Circumferential alignment of the lubrication channel 10 with the longitudinal slit 2 provides the added convenience of grease application through the same opening by which the metal insert 6 engages the umbrella canopy, thereby avoiding the need for a separate dedicated lubricant port.

Applicant's prototype employs a neoprene plug to which application of silicone lubricant via the described lubricant/greasing channel 10 has been found to provide an easily maintained, low-friction sliding interface between the components that aids in minimizing the air pressure required to raise an umbrella canopy. Testing of the prototype has been found capable of fully raising an umbrella canopy at relatively low pressure values easily obtainable with a human-powered foot pump or hand pump, thereby providing both safety and convenience by operating well below potential blowout levels and avoiding the need for a powered air source. Testing with various aluminum canopies found that pressures did not exceed 11 psi, and testing with a heavier wooden canopy proved operational, with pressures only reaching approximately 14.5 psi. At operational pressures not exceeding 12 psi for aluminum canopies and not exceeding 15 psi for wooden canopies, the need for a safety-inspected pressure certification and relief valve requirement may be avoidable. However, larger heavier canopies may require certification and/or relief valve safety mechanisms.

Preferred embodiments employ 1.5-inch or 1.75-inch aluminum tubing for the outer pole so as to fit in the umbrella opening 300 of a typical picnic or patio table 302, as schematically shown in FIGS. 2 and 3. Air valve 11 for locking in and subsequently releasing the pumped-in air pressure is preferably provided on either the air hose/tubing 9 or on the pump 14. Preferably the valve 11 and pump 14 are each disposed at a distance of 5-feet or greater along the hose 9 from its connection to the tube 1 so that the air content of the external pole is controllable from outside the footprint of the opened umbrella canopy. Placing the air control components at notable distance from the connection to the pole assembly increases safety by allowing the operator to control movement of the umbrella canopy from a notable distance away, to avoid impact by the moving umbrella ribs or pinching of fingers by movement of the canopy base along the pole.

The disadvantages of the other canopy opening methods mentioned above have been overcome with the invention of the patio umbrella with an air pump. It raises and lowers any patio umbrella easily with the use of either a foot or a hand pump or a low psi compressor. This is a versatile system that can be utilized by anyone with use of their hands or feet and can be completed in either a sitting or standing position. The canopy automatically locks into place when the air pressure relief valve is closed, so individuals do not need to reach or stretch to lock the canopy in place. As long as a person can close and open the air pressure valve they will be able to utilize this umbrella. It also minimizes maintenance issues as there are minimal moving parts and all parts comprise an integrated unit that will function as long as it is regularly lubricated.

This product will allow a person to raise a patio umbrella through the use of an air pump and lower the umbrella by releasing the air via a valve; therefore, making a laborious task easier. Others have tried to modify the process of opening and closing large umbrellas; however, previous efforts have proven to be too complicated in design which detracts from their function. This invention has modified the pole of a patio umbrella to allow for the use of air pressure via a pump (foot, hand held, or low psi compressor) to raise a standard umbrella canopy with minimal effort. This product is intended for use by anyone with a patio umbrella but would be especially helpful for persons with disabilities, ailments (ex. Arthritis) or the elderly.

The invention claimed is:

1. A device for raising an umbrella canopy with air pressure, the device comprising:

an external pole having a base at which the external pole is sealed;

a longitudinal slit in the external pole that communicates an interior of the external pole with an interior thereof;

an internal pole received inside the external pole and having a sliding seal thereon that forms an air-tight seal between the internal and external poles at an area location between the base of the external pole and a lower end of the longitudinal slit, the internal pole and the sliding seal thereon being slidable up and down within the external pole;

an air connection to the external pole for introduction of pumped air into the external pole at a location between the base of the external pole and the sliding seal on the internal pole;

a carrier connected to the internal pole and extending through the longitudinal slit in the external pole to carry a base of the umbrella canopy that is slidably disposed along an exterior of the external pole for lifting of the umbrella canopy by pressurization of the external pole via the air connection in order to raise the carrier from a lowered position in contact with the lower end of the longitudinal slit to a raised position in contact with an opposing upper end of the longitudinal slit; and a longitudinal lubrication channel recessed into an exterior wall of the internal pole at an exterior surface thereof without passing through said exterior wall of the internal pole, the longitudinal lubrication channel extending upwardly from the sliding seal and being positioned to circumferentially align with both the carrier and the longitudinal slit and to axially reach the longitudinal slit in the external pole with the carrier in the raised position to enable lubrication of the sliding seal via the longitudinal slit and the lubrication channel with the carrier in the raised position;

wherein an axial length of the longitudinal slit in the external pole is less than a longitudinal distance measured along the internal pole from the carrier to the sliding seal so that the sliding seal remains below the lower end of the longitudinal slit throughout a full range of movement of the carrier between the raised and lowered positions in the longitudinal slit, thereby maintaining the air-tight seal with the external pole at all times.

2. The device of claim 1 wherein the sliding seal comprises neoprene and/or silicone.

3. The device of claim 1 comprising silicone lubricant applied to the sliding seal.

4. The device of claim 2 comprising silicone lubricant applied to the sliding seal.

5. The device of claim 1 comprising an air hose having an output end coupling to the air connection of the external pole, an input end coupling to an air pump and a length of at least 5 feet between the input and output ends thereof.

6. The device of claim 5 in combination with the air pump and comprising an air control valve is operably connected to the air hose at a distance of at least 5-feet along the hose from the output end of said air hose.

7. The device of claim 1 comprising an air hose having an output end coupling to the air connection of the external pole and an input end coupling to an air pump, and an air control valve operably connected to the air hose at a distance of at least 5-feet along the hose from the output end of said air hose.

8. A device for raising an umbrella canopy with air pressure, the device comprising:

an external pole having a base at which the external pole is sealed;

a longitudinal slit in the external pole that communicates an interior of the external pole with an interior thereof;

an internal pole received inside the external pole and having a sliding seal thereon that forms an air-tight seal between the internal and external poles at an area location between the base of the external pole and a lower end of the longitudinal slit, the internal pole and the sliding seal thereon being slidable up and down within the external pole;

an air connection to the external pole for introduction of pumped air into the external pole at a location between the base of the external pole and the sliding seal on the internal pole;

a carrier connected to the internal pole and extending through the longitudinal slit in the external pole to carry a base of the umbrella canopy that is slidably disposed along an exterior of the external pole for lifting of the umbrella canopy by pressurization of the external pole via the air connection in order to raise the carrier from a lowered position in contact with the lower end of the longitudinal slit to a raised position in contact with an opposing upper end of the longitudinal slit; and a longitudinal lubrication channel recessed into an exterior wall of the internal pole at an exterior surface thereof without passing through said exterior wall of the internal pole, the longitudinal lubrication channel extending upwardly from the sliding seal, having a circumferential position on the internal pole that matches circumferential positions of the carrier and the longitudinal slit, and having an axial length sufficient to reach up to the longitudinal slit with the carrier in the raised position so as to place a top end of the lubrication channel at the longitudinal slit when the carrier is in the raised position for lubrication of the sliding seal via longitudinal slit and said lubrication channel;

wherein an axial length of the longitudinal slit in the external pole is less than a longitudinal distance measured along the internal pole from the carrier to the sliding seal so that the sliding seal remains below the lower end of the longitudinal slit throughout a full range of movement of the carrier between the raised and lowered positions in the longitudinal slit, thereby maintaining the air-tight seal with the external pole at all times.

9. The device of claim 8 wherein the sliding seal comprises neoprene and or silicone.

10. The device of claim 8 comprising silicone lubricant applied to the sliding seal.

11. the device of claim 10 comprising silicone lubricant applied to the sliding seal.

12. The device of claim 8 comprising an air hose having an output end coupling to the air connection of the external pole, an input end coupling to an air pump and a length of at least 5 feet between the input and output ends thereof.

13. The device of claim 12 in combination with the air pump and comprising an air control valve is operably connected to the air hose at a distance of at least 5-feet along the hose from the output end of said air hose.

14. The device of claim 8 comprising an air hose having an output end coupling to the air connection of the external pole and an input end coupling to an air pump, and an air control valve operably connected to the air hose at a distance of at least 5-feet along the hose from the output end of said air hose.

* * * * *